US008156596B2

(12) United States Patent
Rose

(10) Patent No.: US 8,156,596 B2
(45) Date of Patent: Apr. 17, 2012

(54) MANUAL ROTARY SWEEPER

(76) Inventor: Brian Rose, Sanford, NC (US)

( * ) Notice: Subject to any disclaimer, the term of this patent is extended or adjusted under 35 U.S.C. 154(b) by 21 days.

(21) Appl. No.: 12/481,809

(22) Filed: Jun. 10, 2009

(65) Prior Publication Data

US 2010/0095466 A1 Apr. 22, 2010

Related U.S. Application Data

(60) Provisional application No. 61/107,561, filed on Oct. 22, 2008.

(51) Int. Cl.
*A46B 13/08* (2006.01)

(52) U.S. Cl. ..... 15/79.1; 15/41.1; 15/42; 15/48; 15/48.1; 15/48.2; 15/88.4

(58) Field of Classification Search ..... 15/41.1, 15/42, 48, 48.1, 48.2, 79.1, 88.4
See application file for complete search history.

(56) References Cited

U.S. PATENT DOCUMENTS

| | | | | | |
|---|---|---|---|---|---|
| 1,972,870 | A | * | 9/1934 | Christesen | 15/41.1 |
| 3,446,666 | A | * | 5/1969 | Bodine | 134/1 |
| 3,638,267 | A | * | 2/1972 | Liebscher | 15/41.1 |
| 3,947,912 | A | * | 4/1976 | Michaels | 15/79.1 |
| 5,239,721 | A | * | 8/1993 | Zahuranec | 15/41.1 |
| 6,125,495 | A | * | 10/2000 | Berg et al. | 15/183 |

* cited by examiner

*Primary Examiner* — Robert Scruggs
(74) *Attorney, Agent, or Firm* — James A. Italia; Italia IP

(57) ABSTRACT

A manually propelled, wheeled rotary brush having a handle and two wheels. The brush may have a generally cylindrical configuration which contacts the environmental surface on which the wheels ride, and may rotate about a horizontal axis disposed perpendicularly to the direction of travel as the wheels turn. The brush may be geared to the wheels, and may rotate faster than the wheels. The wheeled rotary brush may have a frame in which the gears are journaled. The handle may be propped in an elevated position by stabilizing legs disposed to engage the environmental surface at a point spaced apart from the brush. The brush may have replaceable brush elements which may be inserted into slots formed in a cylindrical core of the brush.

16 Claims, 5 Drawing Sheets

MANUAL ROTARY SWEEPER

CROSS-REFERENCE TO RELATED APPLICATIONS

This application claims the benefit of the filing date under 35 USC 119(e) of the filing date of U.S. Provisional Application Ser. No. 61/107,561, filed Oct. 22, 2008, the contents of which are incorporated herein by reference.

FIELD OF THE INVENTION

The present invention pertains to appliances for sweeping surfaces using brush bristle type sweeping elements, and more particularly to a wheeled appliance which sweeps a surface when rolled therealong.

BACKGROUND OF THE INVENTION

Sweeping environmental surfaces of light debris, such as clearing sidewalks of leaves and the like, is a domestic task that is encountered from time to time. Bristle bearing brooms have long been utilized for this purpose. However, a broom or brush must be wielded in a reciprocating motion when hand held. This is tiresome if the task is prolonged, and may take an objectionably long time to complete.

Motorized street sweeping vehicles having rotary brushes are known. These are clearly unsuitable for tasks of more limited scope than street sweeping. Even if miniaturized, the resulting powered sweeper would be cumbersome and heavy to the point that it would defeat the advantages of being powered.

There remains a need for a brush type sweeper which combines the ease of use of a manual implement with the rotary action of motorized street sweeping vehicles.

SUMMARY OF THE INVENTION

The present invention provides a rotary sweeper which is practical for sweeping tasks which are greater in scope than the nominal scope of sweeping the floor of a room in a typical residence, but which is generally manually operated.

The novel rotary sweeper comprises two wheels, a push handle, and a rotary brush which is rotated by the wheels as the wheels roll across an environmental surface. Such a rotary sweeper would be highly practical for sweeping sidewalks as the weight is borne by the wheels, thus sparing the user, while enabling the user to walk behind the rotary sweeper as sweeping progresses. The sweeper can thus sweep surfaces such as sidewalks at the rate of forward progress equal to that at which the user can walk.

BRIEF DESCRIPTION OF THE DRAWINGS

Similar reference characters denote corresponding features consistently throughout the attached drawings.

DETAILED DESCRIPTION

Figure 1:
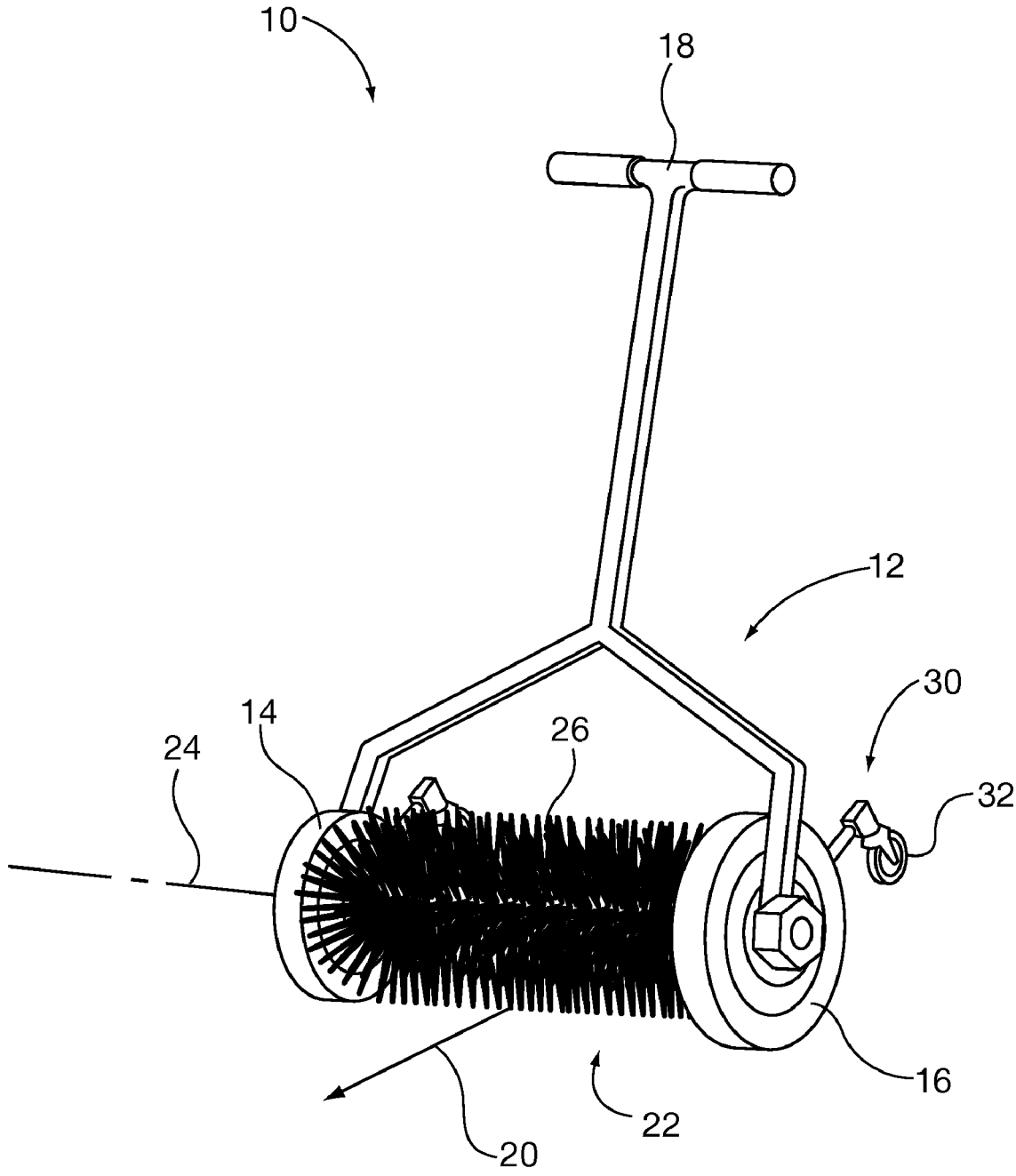
FIG. 1 is a front perspective view of a manual rotary sweeper according to at least one aspect of the invention.

The present invention comprises a manual rotary sweeper 10 which may be propelled by hand by a user (not shown). The manual rotary sweeper 10 may have a frame 12, two main wheels 14, 16 rotatably mounted on the frame 12 in a location such that the two main wheels 14, 16 can contact and roll across a generally environmental surface such as the ground (not shown), and a handle 18 fixed to the frame 12 so as to enable the frame 12 to be pushed along the generally horizontal environmental surface in a direction of motion 20 while the user grasps the handle 18 and walks in the direction of motion 20. This may be done in a manner similar to that by which a push type lawnmower (not shown) is operated.

The manual rotary sweeper 10 may comprise a generally cylindrical brush 22 which is fixed to the frame 12 either directly or indirectly, and which may contacts the environmental surface being rolled across by the two main wheels 14, 16. The cylindrical brush 22 may be journaled in the frame 12 or otherwise supported so as to rotate about a horizontal axis 24 which is generally perpendicular to the direction of motion 20 as it contacts and rolls across the environmental surface being rolled across by the two main wheels 14, 16.

The cylindrical brush 22 may be driven by a gear drive comprising rotatable elements which are disposed to rotate the cylindrical brush 22 about the horizontal axis 24 responsively to the two main wheels 14, 16 rolling across the environmental surface.

The cylindrical brush 22 may have a brushing surface 26 configured in generally cylindrical form. The brushing surface 26 may actually contact the environmental surface or alternatively may be dimensioned and configured so that it doesn't quite contact the environmental surface. For example, if desired to intercept and propel from its path articles of sufficient size, the brushing surface 26 may extend sufficiently even without actually contacting the environmental surface.

The brushing surface 26 and hence the cylindrical brush 22 may be generally cylindrical without being cylindrical in the strictest sense. For example, the cylindrical brush 22 may bear bristles 28, the ends of which collectively form the brushing surface 26 and collectively suggest rather than literally establish a cylindrical form.

The manual rotary sweeper 10 may have a stabilizer disposed to support the handle 18 in an elevated position such as the position depicted in FIG. 1 when the two main wheels 14, 16 are resting on the environmental surface. The stabilizer may take the form of at least one leg 30 fixed to the frame 12. The leg 30 may terminate in a foot disposed to engage the ground when the two main wheels 14, 16 are resting on the environmental surface. The foot may take the form of a rolling element which can roll along an environmental surface, such as a stabilizer wheel 32. The stabilizer wheel 32 may be mounted on the leg 30 so as to be able to swivel about a non-horizontal axis, so that the stabilizer wheel 32 can turn direction independently of the main wheels 14, 16. In particular, the stabilizer wheel 32 may be able to turn direction when the two main wheels 14, 16 roll in a constant direction such as the direction 20. The stabilizer may comprise a second leg 34 which may be essentially similar in structure and function to the leg 30.

Figure 2:
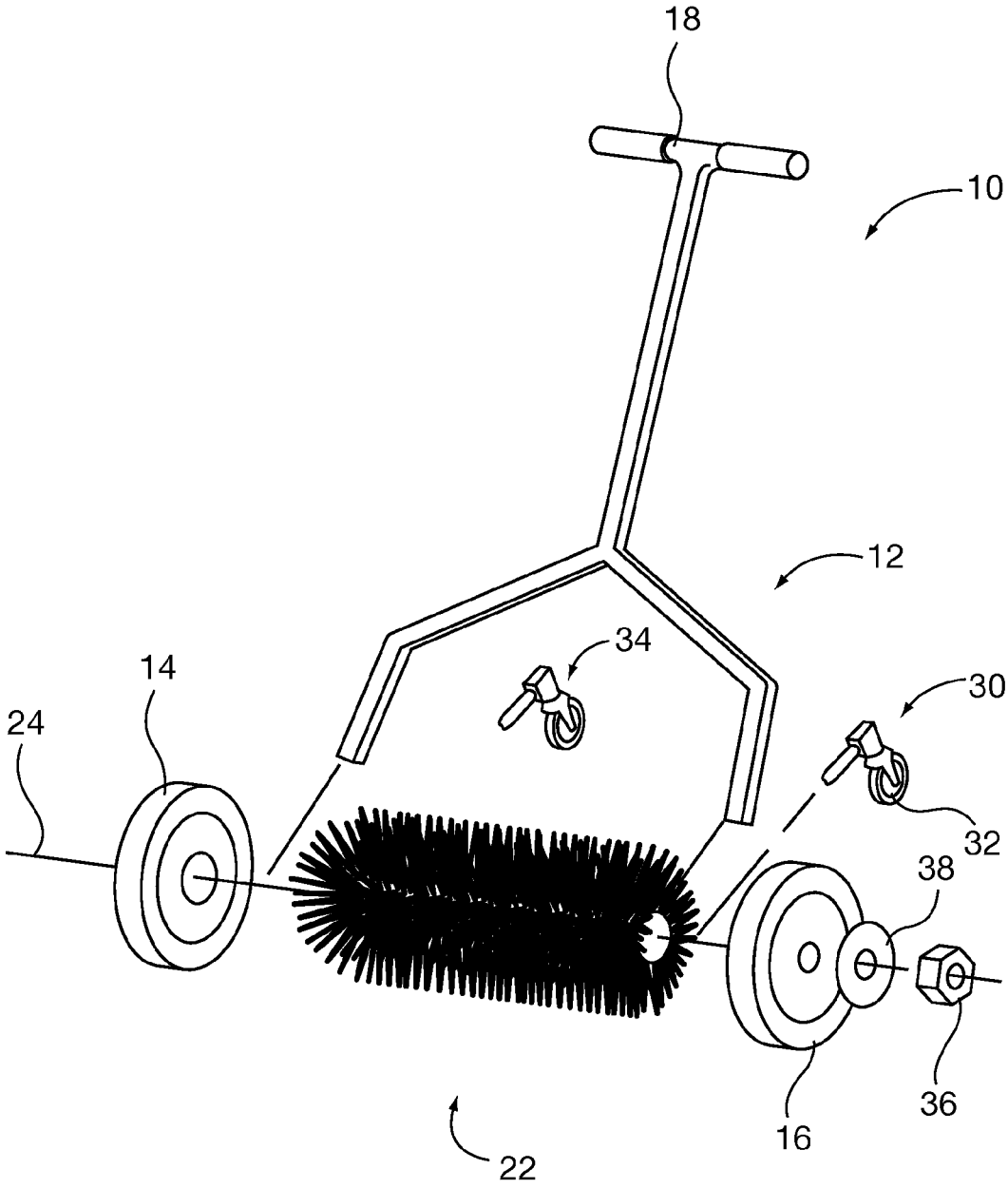
FIG. 2 is a mostly exploded view of FIG. 1.

FIG. 2 shows axial alignment of the cylindrical brush 22 with the main wheels 14, 16. The main wheels 14, 16 may be mounted to the frame 12 by riding on an axle (not shown) in well known fashion and being secured there by nut 36 and washer 38 for example.

Figure 3:
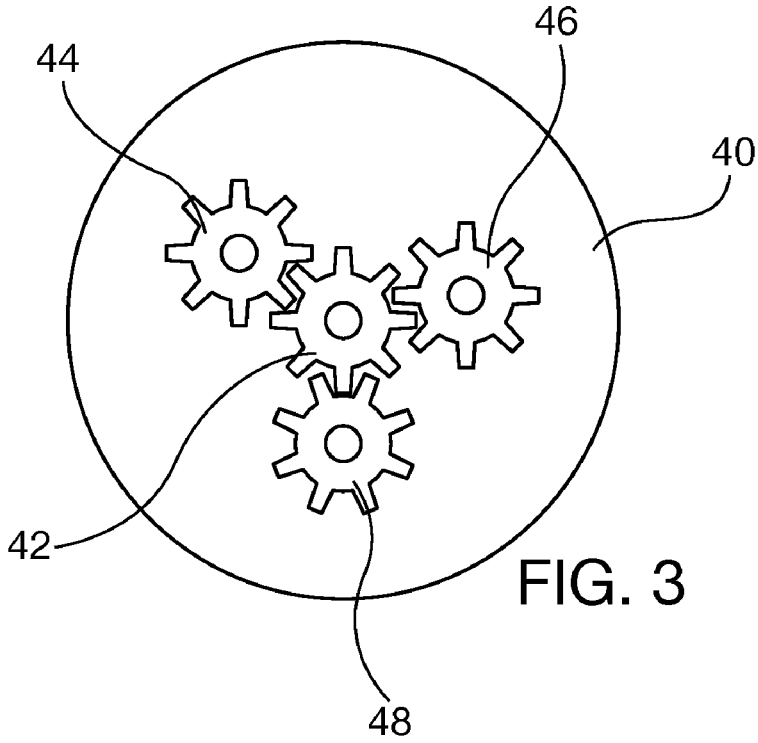
FIG. 3 is a diagrammatic side view of an alternative drive mechanism for a manual rotary sweeper according to another aspect of the invention.
Figure 4:
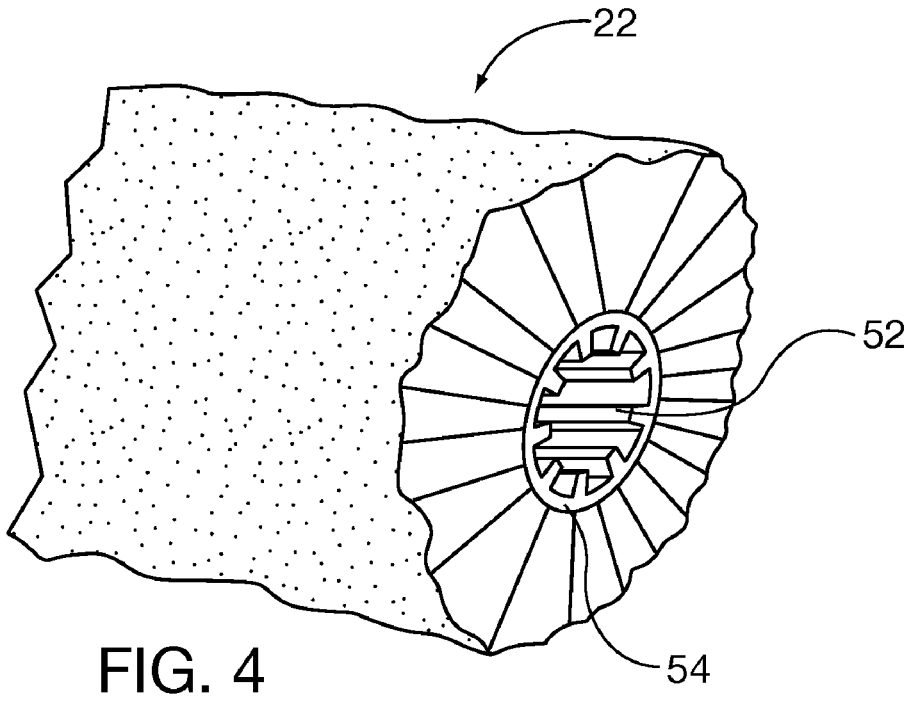
FIG. 4 is an enlarged detail view of a rotary brush for use in a manual rotary sweeper according to at least one aspect of the invention.

FIG. 3 shows a partial drive arrangement which may be utilized to drive the cylindrical brush 22 and a height adjustment feature for elevating the cylindrical brush 22 relative to the environmental surface. The cylindrical brush 22 may comprise a side plate 40. The partial drive arrangement of FIG. 3 includes a central first gear 42 fixed or drivably engaging the cylindrical brush 22 and three surrounding intermediate gears 44, 46, 48 which drivably engage the central first gear 42. The intermediate gears 44, 46, 48 may in turn a second gear (not shown) formed as part of or solidly fixed to a main wheel 14 or 16. The position of two of the intermediate gears 44, 46, 48 may be adjusted relative to the plate 40 so that the plate 40 and the cylindrical brush 22 are moved vertically either up or down relative to the ground or environmental surface.

This may be accomplished by forming an arcuate slot 50 in the plate 40. A second arcuate slot (not shown) of suitable geometry may complement the arcuate slot 50 so that the axis of the cylindrical brush 22 can shift to achieve the vertical adjustment.

Rotational engagement among the central first gear 42 and the intermediate gears 44, 46, 48, and a gear (not shown) fixed to a main wheel 14 or 16 causes any one of these gears 42, 44, 46, 48 to be drivably engaged with the others. The central first gear 42 may comprise a splined shaft (not shown) which engages a correspondingly splined hole 52 formed in the core 54 of the cylindrical brush 22. The splined hole 52 may be regarded as a gear of the cylindrical brush 22 to which torque is transmitted from the intermediate gears 44, 46, 48 via the central gear 42, which may be regarded as a brush drive gear.

Figure 5:
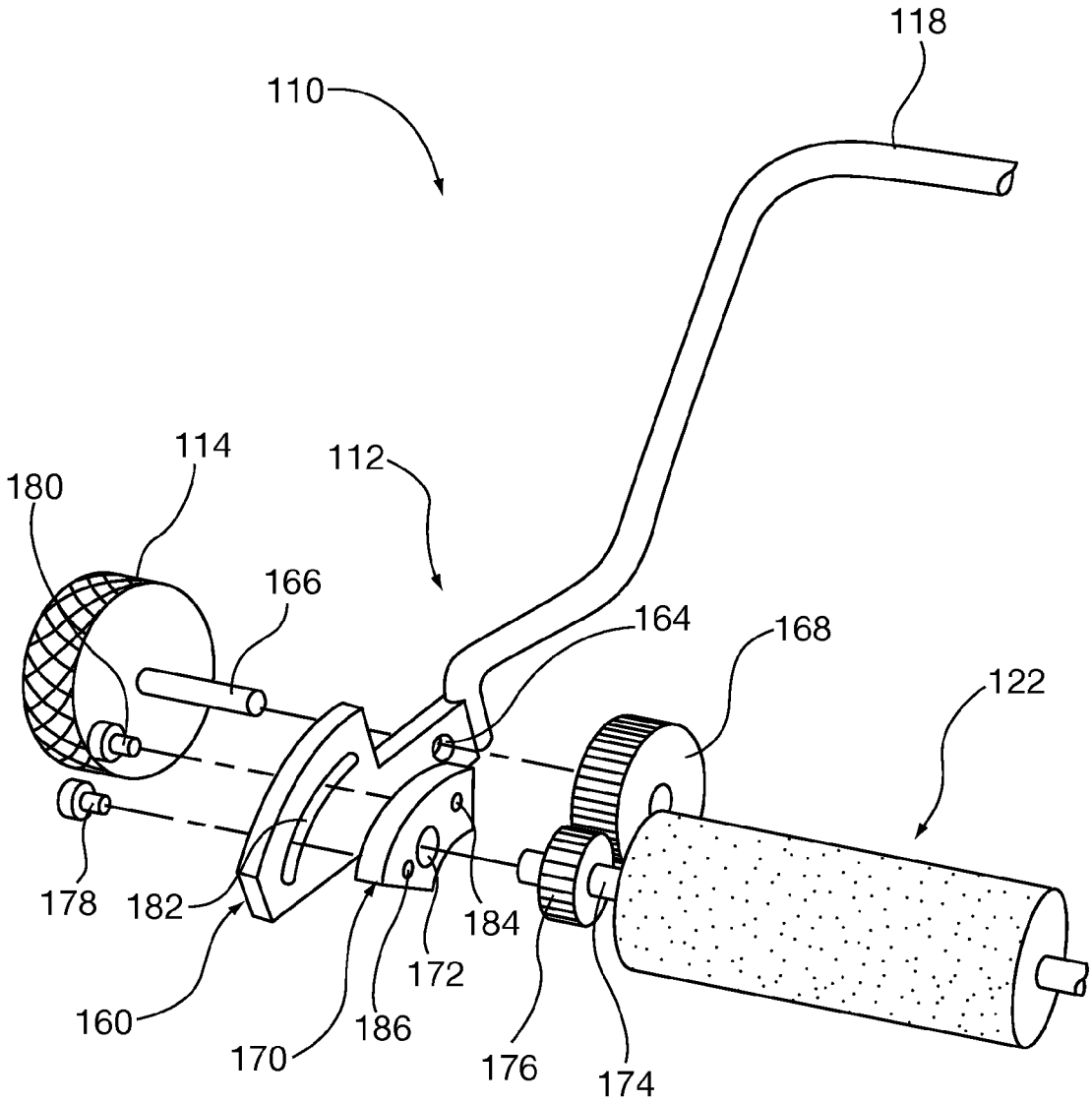
FIG. 5 is a fragmentary mostly exploded view of a drive mechanism for a manual rotary sweeper according to a further aspect of the invention.

FIG. 5 depicts a drive arrangement for a manual rotary sweeper 110 according to a further aspect of the invention. The manual rotary sweeper 110 may comprise a frame 112 which also forms a handle 118. The frame 112 may comprise a support plate 160 bearing an arcuate slot 162. A hole 164 may be formed in the support plate 160 for receiving and providing journaled support to an axle 166 to which are mounted a main wheel 114 and a driving gear 168. A secondary support plate 170 may bear a hole 172 for receiving and providing journaled support to a brush shaft 174 to which is fixed a cylindrical brush 122 of course, and a driven gear 176. The secondary support plate 170 may be adjustably positioned on the support plate 160 by passing screws 178, 180 through an arcuate slot 182 formed in the support plate 160, and into screw holes 184, 186 formed in the secondary support plate 170. Before tightening the screws 178,180, the secondary support plate 170 may be moved along the arcuate slot 182 to adjust height of the cylindrical brush 122 on its frame 112.

In the arrangement of FIG. 5, the gear 176 may be considered to be a first gear fixed to the cylindrical brush 122, and the gear 168 may be considered a second gear which is drivably engaged with the first gear (gear 176).

It should be mentioned here that the manual rotary sweeper 110 may be bilaterally symmetrical so that the structure shown on the right side of the manual rotary sweeper 110, as viewed from the vantage point of a person holding the handle 118 and pushing the manual rotary sweeper 110, may be repeated in mirror image on the left side (not shown). Therefore, while only one second gear (gear 168) is actually depicted, the two main wheels (i.e., the main wheel 114 and its counterpart on the left side of the manual rotary sweeper 110, not shown) may collectively comprise at least one second gear and optionally two second gears. The first gear (gear 176) may engage one of the second gears and if a second first gear (not shown) is provide on the left side of the manual rotary sweeper 110, then two first gears may engage two second gears in mutually rotatable fashion.

If the arrangement of FIG. 3 is adopted, then there would be at least one intermediate gear (i.e., one of the intermediate gears 44, 46, 48) interposed drivably between the first gear and the at least one second gear.

Returning to FIG. 5, the gear drive established by the gear, wheel, and axle components described with respect to the manual rotary sweeper 110 may be said to comprise a gear drive therefor. The gear drive may be disposed to rotate the cylindrical brush 122 at a first rotational speed when the two main wheels (i.e., the main wheel 114 and its counterpart at the opposed left side) rotate at a second rotational speed. For example, and as depicted, the first rotational speed of the cylindrical brush 122 will be greater than the second rotational speed of the two main wheels.

The holes 164 and 172 and their respective supporting elements, such as the frame 112, the support plate 160, and the secondary support plate 170 may be said to comprise a journaling arrangement which constrains the rotatable elements of the drive against motion relative to the cylindrical brush 122 which motion is other than rotation about their drive axes. If this constraint were not present, one of the gears of the gear drive could walk or rotate ineffectually about another member of the gear drive. A similar or another constraint arrangement may be incorporated into the arrangement of FIG. 3 if desired to assure operability.

Figure 6:
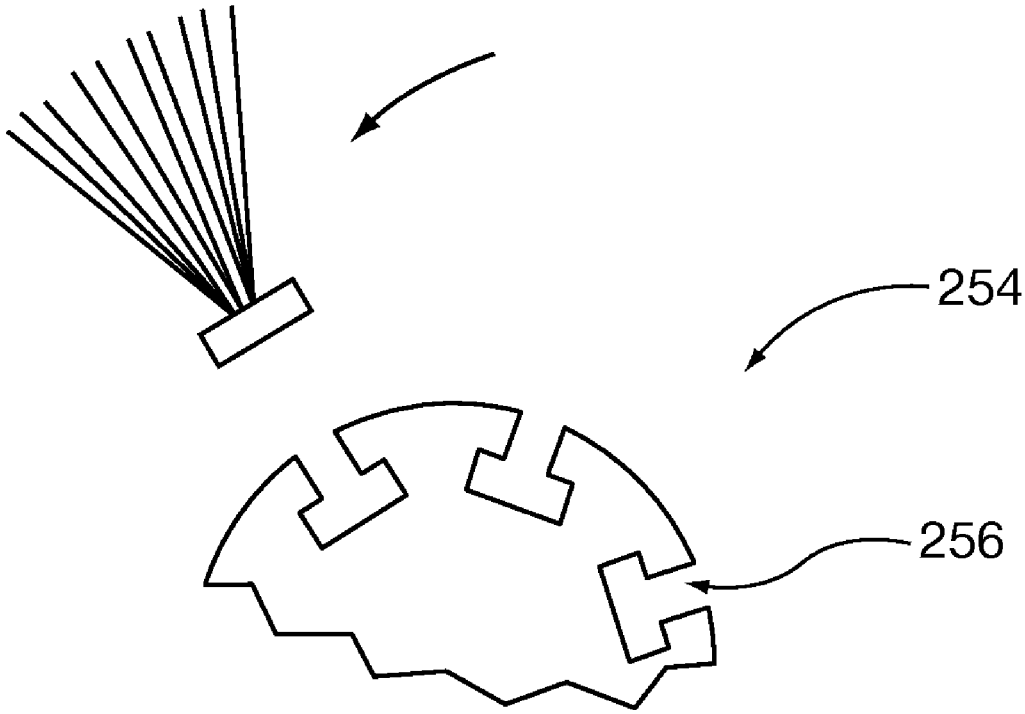
FIG. 6 is an enlarged detail side view of a rotary brush for a manual rotary sweeper according to another aspect of the invention.

FIG. 6 shows a feature which enables ready replacement of part of a brush element, such as the bristles 28 of the cylindrical brush 22 of FIG. 1. In the arrangement of FIG. 6, a cylindrical brush, which in other ways may be a structural or functional equivalent of the cylindrical brushes 22 and 122, has a core 254 for holding and supporting a brushing surface, which may comprise the collective outer ends of bristles similar to the bristles 28. The core 254 may bear recesses in the form of T-slots 256. The brushing surface may be provided in replaceable complementing sections such as the section 258 which may be received within the T-slots 256. Close cooperation between the solid base 260 of each section such as the section 258 is such that the section 258 is solidly held and retained within its T-slot 256, while enabling the complementing sections 258 to be removed from and installed on the core 254 by sliding laterally in a direction parallel to the horizontal axis (not shown, but similar to the horizontal axis 24 of the manual rotary sweeper 10.

It should be understood that any feature presented herein may be incorporated into or omitted from a manual rotary sweeper according to the present invention where feasible, such as the manual rotary sweepers 10 and 110. For example, the manual rotary sweeper 110 may have stabilizers such as the stabilizer legs 30, 34.

The present invention is susceptible to variations and modifications which may introduced thereinto while conforming to the inventive concept. For example, a cylindrical brush such as the cylindrical brush 22 may be arranged at an acute angle to the direction of motion rather than being perpendicular thereto. The actual angle may be adjustable. The cylindrical brush may be formed in two sections (not shown) which collectively form a V configuration for example.

While the present has been described in connection with what is considered the most practical and preferred embodiments, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

What is claimed is:

1. A manual rotary sweeper comprising:

a frame;

two main wheels rotatably mounted on the frame in a location such that the two main wheels can contact and roll across an environmental surface;

a handle fixed to the frame to enable the frame to be pushed along a generally horizontal environmental surface in a direction of motion while the user grasps the handle and walks in the direction of motion;

a brush disposed to rotate about a horizontal axis which is generally perpendicular to the direction of motion, wherein the brush is fixed to the frame and contacts the environmental surface being rolled across by the two main wheels, and wherein the brush further comprises internally facing teeth disposed coaxially along the entire length of its horizontal axis; and a gear drive comprising rotatable elements disposed to rotate the brush about the horizontal axis responsively to the two main wheels rolling across the environmental surface.

2. The manual rotary sweeper of claim 1, wherein the brush has a brushing surface configured in generally cylindrical form.

3. The manual rotary sweeper of claim 2, wherein the brush comprises a core disposed to hold and support the brushing surface.

4. The manual rotary sweeper of claim 3, wherein the brushing surface is provided in replaceable complementing sections, and the core has recesses formed therein for replaceably receiving the complementing sections.

5. The manual rotary sweeper of claim 4, wherein the recesses formed in the core comprise T-slots enabling the complementing sections to be removed from and installed on the core by sliding laterally in a direction parallel to the horizontal axis.

6. The manual rotary sweeper of claim 1, wherein the brush bears bristles.

7. The manual rotary sweeper of claim 1, further comprising a stabilizer disposed to support the handle in an elevated position when the two main wheels are resting on the environmental surface.

8. The manual rotary sweeper of claim 7, wherein the stabilizer comprises at least one leg fixed to the frame, wherein the leg terminates in a foot disposed to engage the ground when the two wheels are resting on the environmental surface.

9. The manual rotary sweeper of claim 8, wherein the foot comprises a rolling element which is disposed to roll along the environmental surface.

10. The manual rotary sweeper of claim 9, wherein the rolling element comprises a stabilizer wheel which is disposed to be able to turn direction when the two main wheels roll in a constant direction.

11. The manual rotary sweeper of claim 7, wherein the stablilizer comprises two legs fixed to the frame, wherein each of the legs terminates in a foot disposed to engage the ground when the two main wheels are resting on the environmental surface.

12. The manual rotary sweeper of claim 1, wherein the two main wheels collectively comprise at least one second gear, and the splined shaft drivably engages the at least one second gear in mutually rotatable fashion.

13. The manual rotary sweeper of claim 12, wherein the gear drive comprises at least one intermediate gear interposed drivably between the splined shaft and the at least one second gear.

14. The manual rotary sweeper of claim 12, wherein the gear drive is disposed to rotate the brush at a first rotational speed when the two main wheels rotate at a second rotational speed.

15. The manual rotary sweeper of claim 14, wherein the first rotational speed of the brush is greater than the second rotational speed of the two main wheels.

16. The manual rotary sweeper of claim 1, further comprising a journaling arrangement which constrains the rotatable elements of the drive against motion relative to the brush which motion is other than rotation about their said drive axes.

* * * * *